US007631799B2

(12) United States Patent
Turvey et al.

(10) Patent No.: US 7,631,799 B2
(45) Date of Patent: Dec. 15, 2009

(54) CONTAINER AND BLANK FOR MAKING THE SAME

(75) Inventors: Robert R. Turvey, Sanford, MI (US); Brian C. Dais, Saginaw, MI (US); Sanjay Dhall, Canton, MI (US); Daniel Zimmerman, Livonia, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 669 days.

(21) Appl. No.: 11/361,530

(22) Filed: Feb. 23, 2006

(65) Prior Publication Data

US 2006/0138203 A1 Jun. 29, 2006

Related U.S. Application Data

(63) Continuation-in-part of application No. 11/102,965, filed on Apr. 11, 2005.

(60) Provisional application No. 60/561,497, filed on Apr. 13, 2004.

(51) Int. Cl.

| | |
|---|---|
| ***B65D 5/36*** | (2006.01) |
| ***B65D 43/08*** | (2006.01) |
| ***B65D 25/34*** | (2006.01) |
| ***B65D 5/00*** | (2006.01) |
| ***B65D 85/62*** | (2006.01) |
| ***B65D 6/00*** | (2006.01) |
| ***B65D 8/14*** | (2006.01) |

(52) U.S. Cl. ..... 229/117.02; 229/117.01; 229/117.05; 229/117.07; 229/125.19; 229/113; 229/107; 229/116.2; 229/5.5; 206/514; 220/6; 220/796

(58) Field of Classification Search ..... 229/117.02, 229/117.07, 125.19, 117.01, 117.05, 5.5, 229/106, 113, 107, 116.2; 206/514; 220/6, 220/796

See application file for complete search history.

(56) References Cited

U.S. PATENT DOCUMENTS

| | | | |
|---|---|---|---|
| 70,598 | A | 11/1867 | Morgan |
| 241,254 | A | 5/1881 | Udel |

(Continued)

FOREIGN PATENT DOCUMENTS

| | | |
|---|---|---|
| DE | 44 18 666 | 3/1995 |

(Continued)

OTHER PUBLICATIONS

Hoberman Transformable Design: Architecture, "Storage", http://www.hoberman.com/site/storage/storage.html, 1 page, Printed Jan. 23, 2007.

(Continued)

*Primary Examiner*—Gary E Elkins
*Assistant Examiner*—Latrice Byrd

(57) ABSTRACT

A collapsible storage device includes a collapsible container and a lid for the container. The container includes a plurality of resilient wall panels and a hinge portion connecting each adjacent pair of wall panels. The container may be foldably converted between a substantially flat collapsed position and a substantially rectangular prismatic expanded position by articulating the wall panels about the flexible hinges. At least one of the hinge portions is arched to latch the container in the expanded position. The lid may be used to cover the container in the expanded position and receive the container in the collapsed position.

15 Claims, 10 Drawing Sheets

U.S. PATENT DOCUMENTS

| | | | | |
|---|---|---|---|---|
| 680,186 | A | | 8/1901 | Van Wormer |
| 734,449 | A | | 7/1903 | Van Wormer |
| 798,264 | A | | 8/1905 | Carrier |
| 886,462 | A | | 5/1908 | Amos |
| 1,354,928 | A | | 10/1920 | Watson |
| 1,855,045 | A | | 4/1932 | Filmer |
| 1,906,174 | A | * | 4/1933 | Miller ..... 220/9.2 |
| 1,921,946 | A | | 8/1933 | Rudowitz |
| 2,006,811 | A | | 7/1935 | Mersbach |
| 2,067,998 | A | * | 1/1937 | Williamson ..... 229/116.1 |
| 2,859,905 | A | | 11/1958 | Choate |
| 2,914,210 | A | | 11/1959 | Paston |
| 3,254,786 | A | | 6/1966 | Melville |
| 3,354,924 | A | | 11/1967 | Birrell et al. |
| 3,369,727 | A | * | 2/1968 | Wright ..... 229/248 |
| 3,376,994 | A | | 4/1968 | Flinn, Jr. |
| 3,424,365 | A | | 1/1969 | Venturi |
| 3,445,052 | A | | 5/1969 | Lewallen |
| 3,497,127 | A | | 2/1970 | Box |
| 3,655,114 | A | | 4/1972 | Turner |
| 3,796,342 | A | | 3/1974 | Sanders et al. |
| 3,858,745 | A | | 1/1975 | Cloyd |
| 3,870,185 | A | | 3/1975 | Sanders et al. |
| 3,955,703 | A | | 5/1976 | Zebarth |
| 4,005,795 | A | | 2/1977 | Mikkelsen et al. |
| 4,057,165 | A | | 11/1977 | Kardell |
| 4,064,206 | A | | 12/1977 | Seufert |
| 4,164,316 | A | | 8/1979 | Gooding |
| 4,179,252 | A | | 12/1979 | Seufert |
| 4,235,345 | A | | 11/1980 | Vandedrink et al. |
| 4,235,346 | A | | 11/1980 | Liggett |
| 4,252,266 | A | | 2/1981 | Kupersmit |
| 4,405,077 | A | | 9/1983 | Kupersmit |
| D285,906 | S | | 9/1986 | Tyler |
| 4,678,095 | A | | 7/1987 | Barnett et al. |
| 4,684,034 | A | | 8/1987 | Ono et al. |
| 4,694,986 | A | | 9/1987 | Chou |
| 4,717,524 | A | | 1/1988 | Aoki |
| 4,722,473 | A | * | 2/1988 | Sandrini et al. ..... 229/117.01 |
| 4,746,059 | A | | 5/1988 | Jackson |
| 4,757,909 | A | | 7/1988 | Matsuura |
| 4,780,261 | A | | 10/1988 | Vajtay |
| 4,781,300 | A | | 11/1988 | Long |
| 4,790,714 | A | | 12/1988 | Schnapp |
| 4,813,200 | A | | 3/1989 | Kirschner |
| 4,819,824 | A | | 4/1989 | Longbottom et al. |
| 4,826,039 | A | | 5/1989 | Landis |
| 4,828,132 | A | | 5/1989 | Francis, Jr. et al. |
| 4,872,586 | A | | 10/1989 | Landis |
| 4,886,184 | A | | 12/1989 | Chamourian |
| 4,930,644 | A | | 6/1990 | Robbins, III |
| 4,938,413 | A | | 7/1990 | Wolfe |
| 4,946,430 | A | | 8/1990 | Kohmann |
| 4,948,039 | A | | 8/1990 | Amatangelo |
| 4,953,735 | A | | 9/1990 | Tisbo et al. |
| D318,015 | S | | 7/1991 | DeCoster et al. |
| 5,048,707 | A | | 9/1991 | Hallberg |
| 5,064,068 | A | | 11/1991 | Sheng |
| 5,081,740 | A | | 1/1992 | Smith |
| 5,183,672 | A | | 2/1993 | Fetterhoff et al. |
| D336,613 | S | | 6/1993 | Zutler |
| D336,850 | S | | 6/1993 | Guillin |
| 5,230,689 | A | | 7/1993 | Derby |
| 5,257,707 | A | | 11/1993 | Soede |
| 5,268,138 | A | | 12/1993 | Fetterhoff et al. |
| 5,275,300 | A | | 1/1994 | Johnson |
| 5,292,242 | A | | 3/1994 | Robbins, III |
| 5,299,704 | A | | 4/1994 | Thorby |
| 5,300,748 | A | | 4/1994 | Colombo |
| D354,436 | S | | 1/1995 | Krupa |
| 5,384,138 | A | | 1/1995 | Robbins, III et al. |
| D358,936 | S | | 6/1995 | Wagaman, III |
| 5,437,386 | A | | 8/1995 | Von Hodt |
| 5,472,107 | A | | 12/1995 | Lieber |
| D366,212 | S | | 1/1996 | Jones |
| D366,830 | S | | 2/1996 | Christianson |
| D367,609 | S | | 3/1996 | Frank et al. |
| 5,501,758 | A | | 3/1996 | Nitardy |
| 5,524,789 | A | | 6/1996 | Jackman |
| 5,554,093 | A | | 9/1996 | Porchia et al. |
| 5,555,989 | A | | 9/1996 | Moran, Jr. |
| 5,575,398 | A | | 11/1996 | Robbins, III |
| 5,622,276 | A | | 4/1997 | Simmons |
| D387,272 | S | | 12/1997 | Lippincott |
| 5,699,914 | A | | 12/1997 | Broersma |
| 5,699,925 | A | | 12/1997 | Petruzzi |
| 5,735,423 | A | | 4/1998 | Black |
| 5,743,405 | A | | 4/1998 | Reid |
| 5,746,871 | A | | 5/1998 | Walsh |
| 5,762,262 | A | | 6/1998 | Martin |
| 5,772,070 | A | | 6/1998 | Hayes et al. |
| 5,772,110 | A | | 6/1998 | Garretson |
| 5,785,179 | A | | 7/1998 | Buczwinski et al. |
| 5,833,116 | A | | 11/1998 | Guillin |
| 5,839,604 | A | | 11/1998 | Straussman |
| D409,484 | S | | 5/1999 | Tasker |
| 5,918,743 | A | | 7/1999 | Uitz |
| D415,680 | S | | 10/1999 | Sheffer |
| 5,975,411 | A | | 11/1999 | Windolph, III |
| 5,979,690 | A | | 11/1999 | Hartley |
| 5,996,882 | A | | 12/1999 | Randall |
| D421,901 | S | | 3/2000 | Hill |
| D421,902 | S | | 3/2000 | Hill |
| 6,032,815 | A | | 3/2000 | Elstone |
| 6,050,410 | A | | 4/2000 | Quiron |
| 6,050,482 | A | | 4/2000 | Cai |
| 6,056,138 | A | | 5/2000 | Chen |
| D427,063 | S | | 6/2000 | May |
| 6,092,687 | A | | 7/2000 | Hupp et al. |
| 6,098,827 | A | | 8/2000 | Overholt et al. |
| 6,102,280 | A | | 8/2000 | Dowd |
| 6,112,928 | A | | 9/2000 | Black et al. |
| 6,116,501 | A | | 9/2000 | Hupp |
| 6,126,065 | A | | 10/2000 | Wee |
| 6,170,696 | B1 | | 1/2001 | Tucker et al. |
| D437,686 | S | | 2/2001 | Balzar et al. |
| 6,196,404 | B1 | | 3/2001 | Chen |
| D442,081 | S | | 5/2001 | Paul |
| 6,245,277 | B1 | | 6/2001 | Diamond |
| 6,279,774 | B1 | | 8/2001 | Clute et al. |
| 6,315,151 | B1 | | 11/2001 | Hupp et al. |
| 6,325,239 | B2 | | 12/2001 | Randall et al. |
| 6,386,437 | B1 | | 5/2002 | Larson, Jr. |
| 6,401,968 | B1 | | 6/2002 | Huang et al. |
| 6,405,888 | B1 | | 6/2002 | Overholt et al. |
| 6,435,384 | B1 | | 8/2002 | Davis et al. |
| 6,564,960 | B1 | | 5/2003 | Grindstaff et al. |
| 6,585,129 | B2 | | 7/2003 | Moody et al. |
| 6,609,633 | B1 | | 8/2003 | Dyble et al. |
| 6,612,441 | B2 | | 9/2003 | Lang et al. |
| 6,648,159 | B2 | | 11/2003 | Prutkin et al. |
| 6,669,045 | B2 | * | 12/2003 | Wang ..... 220/9.2 |
| 6,682,686 | B1 | | 1/2004 | Iwasaki et al. |
| D487,347 | S | | 3/2004 | Felsenthal |
| 6,761,279 | B1 | | 7/2004 | Martin et al. |
| D496,585 | S | | 9/2004 | McBride et al. |
| 6,805,659 | B2 | | 10/2004 | Bohrer |
| 6,976,602 | B1 | | 12/2005 | Maxwell |
| 2002/0179600 | A1 | | 12/2002 | King |
| 2002/0189166 | A1 | | 12/2002 | Weder |
| 2003/0010814 | A1 | | 1/2003 | Lorusso |
| 2003/0052158 | A1 | | 3/2003 | Spindel et al. |
| 2003/0168452 | A1 | | 9/2003 | Prutkin et al. |
| 2004/0069780 | A1 | | 4/2004 | Apps et al. |

| | | | |
|---|---|---|---|
| 2004/0155037 | A1 | 8/2004 | Hoogland |
| 2004/0164132 | A1 | 8/2004 | Kuester |
| 2005/0035186 | A1 | 2/2005 | Casalotto |
| 2005/0061859 | A1 | 3/2005 | Hennessy |
| 2005/0230390 | A1 | 10/2005 | Glenn |
| 2007/0007289 | A1 | 1/2007 | Hoberman |
| 2007/0045311 | A1 | 3/2007 | Wang |

FOREIGN PATENT DOCUMENTS

| | | | |
|---|---|---|---|
| EP | 76624 | A1 * | 4/1983 |
| GB | 1 580 996 | | 12/1980 |
| GB | 2 367 283 | | 4/2002 |

OTHER PUBLICATIONS

Hoberman Transformable Design: Architecture, "Future", http://www.hoberman.com/site/future/future.html, 1 page, Printed Jan. 23, 2007.

Hoberman Transformable Design: Who We Are, http://www.hoberman.com/site/who_we_are/history.html, 2 pages, Printed Jan. 23, 2007.

Columbia Magazine, "The Future Tents", http://www.columbia.edu/cu/alumni/Magazine/Spring2006/hoberman.., 8 pages, Printed Jan. 23, 2007.

Web Page "Pactiv Air® Systems," at http:--pactiv.com-PactivAir- dated Sep. 18, 2004 (1 page).

Web Page "Hefty Express®," at http:--www.pactiv.com-Heftyexpress-indexmailers.asp dated Sep. 18, 2004 (1 page).

Web Page "Hefty® Slide-Rite® Closure Solutions," at http:--pactiv.com-sliderite- dated Sep. 18, 2004 (1 page).

Web Page "Hinged Lid Containers," at http:--pactivpartners.pactiv.com-productcatalog-Rooms-DisplayPages-LayoutInitial?Contai... dated Sep. 18, 2004 (1 page).

Web Page "Paperboard Hinged Take-Out Containers," at http:--pactivpartners.pactiv.com-productcatalog-Rooms-DisplayPages-LayoutInitial?Contai... dated Sep. 18, 2004 (1 page).

Web Page "Kitchen Seal n Saver Containers," at http:--www.rubbermaid.com-hpd-consumer-product-list.jhtml dated Sep. 18, 2004 (1 page).

Web Page "Stuffables™ Storage Containers," at http:--order.tupperware.com-ls-htprod_www-tup_show_item.show_item_detail dated Sep. 18, 2004 (1 page).

Web Page "FlatOut! Containers," at http:--il3.ebayimg.com-03-i-02-4a-c6-bb_1_b.JPG dated Sep. 18, 2004 (1 page).

Web Page "SmartCrate™," at http:--www.ipl-mh.com-returnable_containers.asp dated Sep. 20, 2004 (1 page).

Web Page "Techno Bin," at http:--www.techcontainer.com-bulkbins.html dated Sep. 20, 2004 (1 page).

Web Page "ComboFructus," at http:--www.packagingnetwork.com-content-productshowcase-prodct.asp?docid=140155e... dated Sep. 19, 2004 (1 page).

Web Page "The Repak Insulated Pallet Shipper," at http:--www.packagingnetwork.com-content-productshowcase-product.asp?docid=03b28f71... dated Sep. 19, 2004 (1 page).

Web Page "Heavy Duty Collapsible Bin Box, 48" X 40 at http:--www.cisco-eagle.com-miva-merchant.mv?Screen=PROD&Store_Code=CEI&Produ... dated Sep. 18, 2004 (1 page).

Web Page "Xytec Gemini," at http:--www.packagingnetwork.com-content-productshowcase-product.asp?docid=1401552... dated Sep. 19, 2004 (1 page).

Web Page "Melog™ Collapsible Hand-Held Container," at http:--www.packagingnetwork.com-content-productshowcase-product.asp?docid=7d478a0... dated Sep. 19, 2004 (1 page).

Web Page "Collapsible Plastic Tote Bin," at http:--www.packagingnetwork.com-content-productshowcase-product.asp?docid=6e4bc74... dated Sep. 19, 2004 (1 page).

Web Page "Packaging Network: Digital Marketplace for the Packaging Industry," at http:--www.packagingnetwork.com-Catalgo2-CatalogBrowse.asp?CatID=RehrigPacific&B... dated Sep. 19, 2004 (1 page).

Web Page "IPL SmartCrate for Eggs," at http:--www.packagingnetwork.com-content-productshowcase-product.asp?docid=4f27cf19... dated Sep. 19, 2004 (1 page).

Web Page "Folding Crate," at http:--www.containerstore.com-browse-Product.jhtml?PRODID=60192&CATID=239 dated Sep. 19, 2004 (1 page).

Web Page "Rubbermaid Collapsible Crate," at http:--www.amazon.com-exec-obidos-tg-detail---B00019JP92-ref=k_de_a_smp-104-28421... dated Sep. 18, 2004 (1 page).

Web Page "Plastic Collapsible Containers," http:--www.cherrysind.com-ci-palletscontainers-plastic-collapsible-container.shtml dated Sep. 18, 2004 (6 pages).

Web Page "Storage Boxes Graphite," at http:--www.containerstore.com-browse-Product.jhtml?PRODID=59856&CATID=71230 dated Sep. 19, 2004 (1 page).

Web Page "Collapsible, Reusable Carton," at http:--www.packagingnetwork.com-content-productshowcase-product.asp?docid=5282cfa8... dated Sep. 19, 2004 (1 page).

Web Page "Returnable, Reusable, Collapsible Containers," at http:--www.packagingnetwork.com-content-productshowcase-product.asp?doci=ca4cc9a0... dated Sep. 19, 2004 (1 page).

Web Page "Black Wave Flute Gift Boxes," at http:--www.containerstore.com-browse-Product.jhtml?PRODID=62644&CATID=262 dated Sep. 19, 2004 (1 page).

Web Page "Collapsible Container—Magic," http:--www.magicgoods.com-CollapContM.htm dated Sep. 19, 2004 (1 page).

Web Page "Blue Folding Mesh Cubes," at http:--www.containerstore.com-browse-Product.jhtml?PRODID=72108&CATID=166 dated Sep. 19, 2004 (1 page).

Web Page "Professional's Choice Collapsible Trash and Laundry Container," at http:--www.statelinetack.com-global-product_large_img.jsp?PRODUCT<>ord_ud=745524... dated Sep. 18, 2004 (1 page).

Web Page "Exotainer," at http:--www.packagingnetwork.com-content-productshowcase-product.asp?docid=c4e6fa99... dated Sep. 19, 2004 (1 page).

Web Page "Drake Stand-Up Decoy Bags," at http:--www.cabelas.com-cabelas-en-templates-product-standard-item.jhtml?id=0027683226... dated Sep. 19, 2004 (1 page).

Web Page "NRS Big Basin Water Container," at http:--www.nrsweb.com-shop-product.asp?pfid=2051&src=froogle&refer=2051 dated Sep. 18, 2004.

Web Page "Double Folding Mesh Cube," at http:--www.thecontainerstore.com-browse-Product.jhtml?CATID=166&PRODID=69699&... dated Sep. 17, 2004 (1 page).

Web Page "Making Memories® Crop Can Black Mesh," at http:--www.createforless.com-products-productDetail.asp-?ProductID=76177&GCID=C106... dated Sep. 18, 2004 (1 page).

Web Page "Water Storage Collapsible Water Containers," at http:--lowprice4u.com-shoppingcart-ProductTemplate.ASP?Product-TemplateID=21078&F... dated Sep. 18, 2004 (1 page).

Web Page "Collapsible Fold-A-Jug Water Container," at http:--www.preparedness.com-colfolwatcon.html dated Sep. 18, 2004 (1 page).

Web Page "Crunch Cans," at http:--www.containerstore.com-browse-Product.jhtml?PRODID=62672&CATID=223 dated Sep. 19, 2004 (1 page).

Web Page "Corner Crunch Canvas Hamper," at http:--www.organizes-it-com-pocornercrunch.php dated Sep. 19, 2004 (1 page).

Web Page "Crunch Oval Laundry Basket," at http:--www.organizes-it.com-poovalcrunch.php dated Sep. 19, 2004 (1 page).

Web Page "Outcast Cooler Bags," at http:--www.cabelas.com-cabelas-en-templates-product-standard-item.jhtml?id=0018142316... dated Sep. 19, 2004 (1 page).

Web Page "Collapsible Storage Organizer," at http:--www.coleman.com-coleman-colemancom-detail.asp?product_id=816-100&categoryi... dated Sep. 19, 2004 (1 page).

Web Page "Artic Zone Ultimate 6 Can Collapsible Cooler New w-Tag," at http:--cgi.ebay.com-ws-eBayISAPI.dll?ViewItem&category=11703&item=4308355535&r... dated Sep. 18, 2004 (1 page).

Web Page "Collapsible Insulated Lunch Bag Cooler," at http:--cgi.ebay.com-ws-eBayISAPI.dll?ViewItem&category=11703&item=4324976900&r... dated Sep. 18, 2004 (1 page).

Web Page "Cubitainer-5 Gallon," at http:--www.thegrape.net-browse.cfm-4,9380.html dated Sep. 18, 2004 (1 page).

Web Page "Collapsible Water Jug Container, 5 Gallon," http:--www.gr8gear.com-index.asp?PageAction=VIEWPROD&ProdID=2948 dated Sep. 18, 2004 (1 page).
Catalog Page from Cole-Parmer "Collapsible Container, LDPE," (p. 850).
Web Page "Lewis N. Clark Travel Cup with Pill Container," at http:--www.rei.com-online-store-ProductDisplay?productId =47780043 &storied=8000&cat... dated Sep. 18, 2004 (1 page).
Web Page "Fold 'n Hold," at http:--www.inventorsstudio.com-FoldnHold.html dated Apr. 8, 2004 (2 pages) and Product Packaging Photocopies (4 pages).
Picture of "Collapsible Cubes," by Whitmor.
International Search Report and Written Opinion in PCT/US2005/012430 dated Oct. 7, 2005.

* cited by examiner

CONTAINER AND BLANK FOR MAKING THE SAME

CROSS REFERENCE TO RELATED APPLICATIONS

This application is a continuation-in-part of U.S. patent application Ser. No. 11/102,965, filed Apr. 11, 2005, which claims the benefit, of U.S. Provisional Patent Application No. 60/561,497, filed Apr. 13, 2004, and such applications are hereby incorporated herein by reference in their entireties.

REFERENCE REGARDING FEDERALLY SPONSORED RESEARCH OR DEVELOPMENT

Not applicable.

SEQUENTIAL LISTING

Not applicable.

BACKGROUND OF THE INVENTION

1. Technical Field

The present invention is directed toward a device for storing objects, and more particularly to a collapsible storage device.

2. Background Art

It is sometimes desirable to have a storage device that is convertible between an expanded position and a collapsed position. In the expanded position, the storage device is capable of retaining objects within an interior space. In the collapsed position, the storage device has less or even no storage capabilities but is more convenient to store because it takes up less space.

A collapsible metal box container has a bottom, four sides, and a lid. The bottom and four sides are connected to each other with pin and knuckle hinges. The lid is connected to one of the sides with pin and knuckle hinges. Each of the bottom and two opposing sides is divided into a pair of opposing triangular segments that are connected to each other with pin and knuckle hinges. The box can be folded or unfolded between an expanded box shape and a substantially flat or planar collapsed shape.

A collapsible pasteboard box has a rectangular side wall extending upwardly from each of four peripheral edges of a square bottom wall. Each side wall is articulably connected to each adjacent side wall along one of four linear vertical hinges and is connected to the bottom wall along one of four horizontal hinges. A diagonal hinge in the bottom wall extends from one corner to an opposite corner. A diagonal hinge in each of two opposing side walls extends from a lower corner of the side wall along the bottom wall to an end point along the upper edge of the side wall displaced from an upper corner. The box folds along the hinges between a flat collapsed position and a cubic or rectangular prismatic expanded position. The box has the same footprint outline in both the collapsed position and the expanded position so that a lid accepts the box in both such positions.

Another collapsible paperboard box has a base portion and a lid portion. The base portion has a square bottom wall and four outwardly slanted side walls. Each side wall is articulably connected to each adjacent side wall along one of four outwardly slanted linear hinges and is connected to the bottom wall along one of four horizontal hinges. Two opposing side walls are divided into three generally triangular sections by two converging fold lines extending diagonally from each bottom corner toward a central location along a top edge thereof. The lid portion is articulably attached to a top edge of a third one of the side walls along a horizontal hinge. The base portion folds flat along the hinges and the fold lines, and the lid also has a rim portion that folds flat.

Another collapsible cardboard container has a square bottom, four rectangular side walls extending upwardly from the bottom, and an opening opposite the bottom. A removable lid is provided to cover the opening with a peripheral flange fitting about the side walls. Each side wall is separated into three sections, and at least one of the sections of each of the four side walls is divided into a pair of hingedly connected opposing triangular segments. The container is folded between a collapsed position and an expanded position by twisting the side walls to either fold or unfold the triangular segments.

SUMMARY OF THE INVENTION

In one aspect of the invention, a container includes a plurality of wall panels hingedly connected so as to articulate between an expanded position and a collapsed position. The wall panels define at least a bottom wall, a first side wall, and a second side wall. The first side wall is connected to the bottom wall at a first articulable connection. The second side wall is connected to the bottom wall at a second articulable connection and is connected to the first side wall at an arched elongate hinge. The first side wall comprises at least two panels defining a second hinge extending substantially between diagonal corners of the first side wall. The wall panels are adapted to articulate between the expanded position and the collapsed position about the arched elongate hinge and the second hinge.

In a different aspect of the invention, a collapsible container includes a bottom wall having four peripheral edges. A side wall is articulably connected to each peripheral edge of the bottom wall. Each side wall is articulably connected to an adjacent side wall along a corner thereof. A diagonal fold is defined in each of two opposing side walls and the bottom wall. Each of the corners is arched along a length thereof. The side walls and the bottom wall articulate at the respective folds, the peripheral edges, and the corners between a substantially flat collapsed state and an expanded state defining four side walls, a bottom wall, and an opening opposite the bottom wall.

In another aspect of the invention, a substantially flat blank adapted for assembly into a collapsible box having a bottom wall and four side walls includes a substantially rectangular central wall portion. A side wall portion is articulably connected to each of four peripheral portions of the central wall portion so as to be foldable into a three-dimensional form of the collapsible box. Each side wall portion has two opposite side edges extending between the central wall portion and a distal end of the side wall portion. A fold line is defined in each of the central wall portions and two opposing side wall portions. Each fold line extends between opposite diagonal corners thereof. The fold lines are substantially parallel with each other. Each adjacent side edge of at least one adjacent pair of the side wall portions is arched convexly along a length thereof.

DETAILED DESCRIPTION

Figure 1:
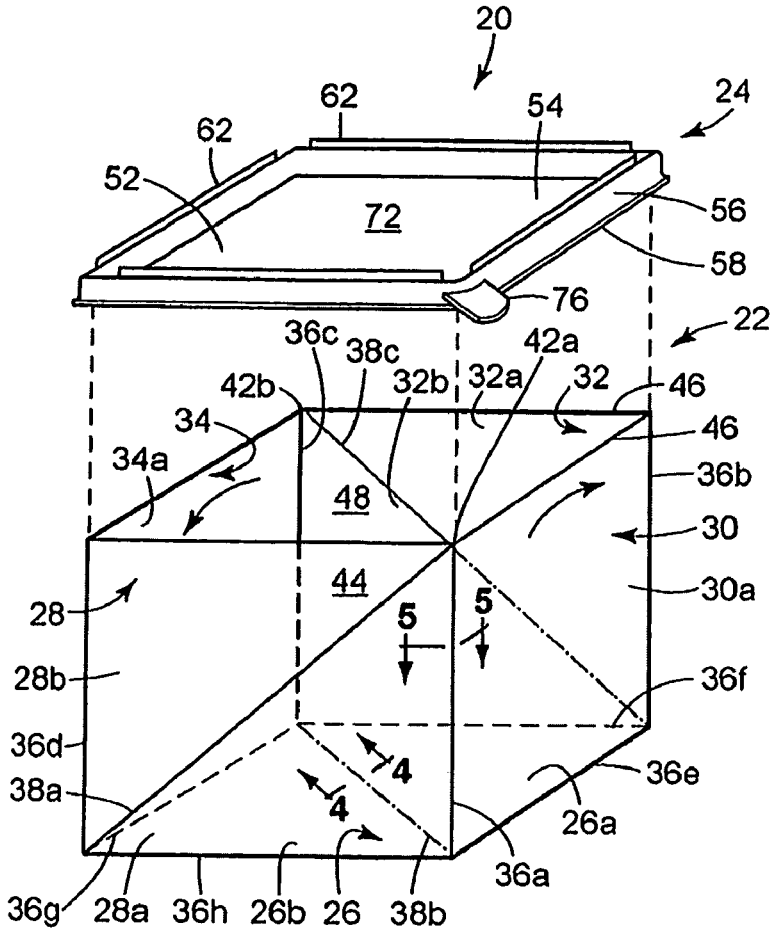
FIG. 1 is an isometric view of a collapsible storage device according to one embodiment of the invention with a lid over an opening of a collapsible container in an expanded position.
Figure 2:
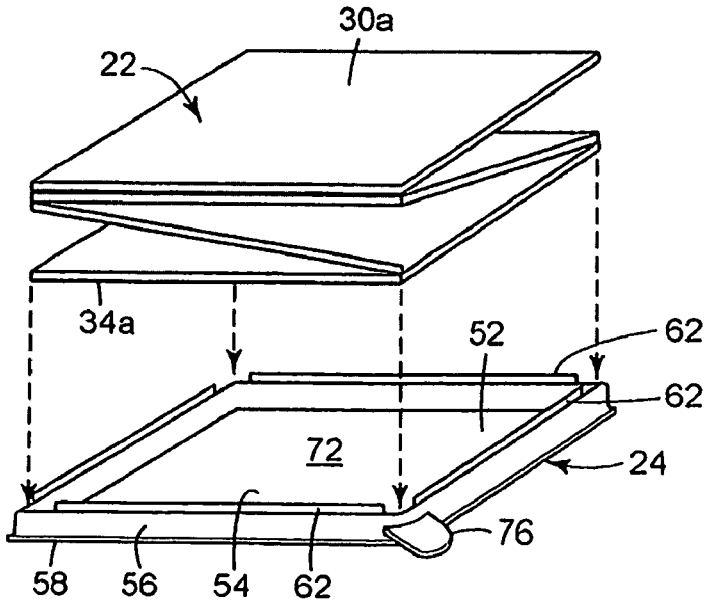
FIG. 2 is an isometric view of the storage device of FIG. 1 with the collapsible container in a collapsed position and ready to be placed in a recessed portion of the lid.
Figure 3:
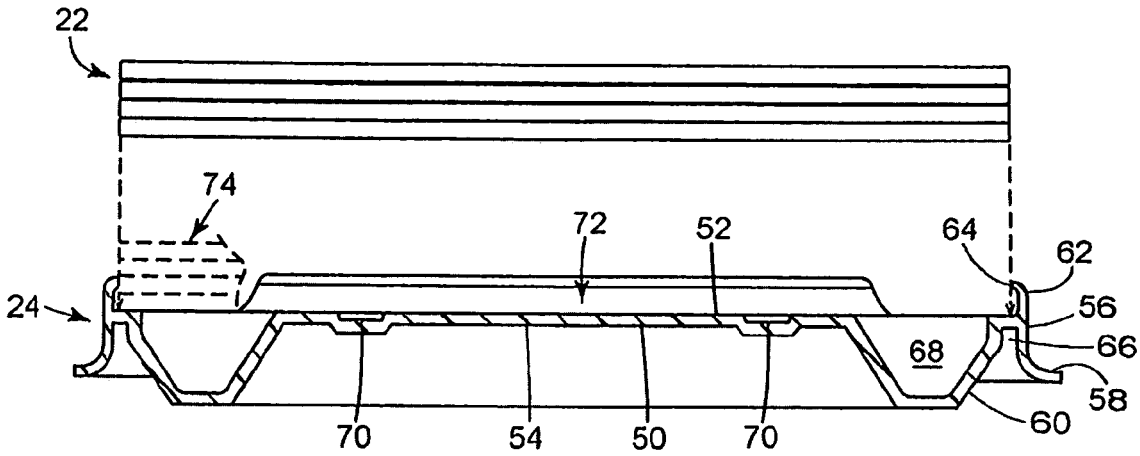
FIG. 3 is a vertical cross-sectional view of the storage device of FIG. 2 with the collapsed collapsible container partly shown fitted into the recessed portion of the lid.

Referring now to FIGS. 1-3, a single unit storage device 20 according to the present invention includes a collapsible container 22 and a lid 24. The container 22 includes resilient wall panels connected by flexible hinges that are convertible between an expanded position as shown in FIG. 1 and a collapsed position as shown in FIG. 2. The container 22 and lid 24 in one embodiment are made of a blow molded or injection molded thermoplastic, such as polypropylene or polyethylene. Further, a polyolefin, nylon, or any other resilient polymeric material may be used. In another embodiment, the container 22 and the lid 24 are made of organic or biodegradable polymers, such as polyesters based on lactic acid, such as polylactic acid (PLA). In yet a further embodiment, the container 22 and the lid 24 are made from paper or any similar substance.

The container 22 includes a bottom wall 26 and four side walls 28, 30, 32, 34 extending upwardly from the outer periphery of the bottom wall. Each of the bottom wall 26 and the side walls 28, 30, 32, 34 is substantially square in shape, although in other embodiments one or more of the walls may have a different shape. Each of the bottom wall 26 and the side walls 28, 32 includes a pair of complimentary triangular panels 26*a*, 26*b*, 28*a*, 28*b*, and 32*a*, 32*b*, respectively, wherein the panels of each pair of complimentary triangular panels are hingedly joined to form the respective wall. Each of the side walls 30, 34 comprises a single panel 30*a* and 34*a*, respectively. Each panel 26*a*, 26*b*, 28*a*, 28*b*, 30*a*, 32*a*, 32*b*, and 34*a* is connected to adjacent panels by one of straight living hinges 36*a*, 36*b*, 36*c*, 36*d*, 36*e*, 36*f*, 36*g*, 36*h*, 38*a*, 38*b*, 38*c* such that the container 22 may be converted from the expanded position shown in FIG. 1 to the substantially flat collapsed position shown in FIG. 2. This conversion is accomplished by moving the panel 30 and the panel 34 in opposite directions (as seen in FIG. 1) so that corners 42*a* and 42*b* converge toward one another. Continued opposite movement of the panels 30*a* and 34*a* results in clockwise rotation of the panel 30*a* and counterclockwise rotation of the panel 34*a* (as seen in FIG. 1) 90 degrees with respect to each other, during which time the panels 26*a* and 26*b*, 28*a* and 28*b*, and 32*a* and 32*b* collapse inwardly toward one another in a folding motion about the hinges 38*b*, 38*a*, and 38*c*, respectively. This collapsing is afforded by movement of the panels 26*a*, 26*b*, 28*a*, 28*b*, 30*a*, 32*a*, 32*b*, and 34*a* about the living hinges 36*a-h*, 38*a-c*. Eventually, the panels 26*a*, 26*b*, 28*a*, 28*b*, 30*a*, 32*a*, 32*b*, and 34*a* collapse into the configuration shown in FIG. 2. The collapsed container 22 may be expanded by reversing the process. Another method of converting the container 22 to the collapsed position is to push the bottom hinge 38*b* upwardly (as depicted in FIG. 1) and the hinges 38*a*, 38*b* inwardly, which causes the same folding and collapsing motion of the panels 26*a,b*; 28*a,b*; and 32*a,b* as heretofore described.

In the expanded position, the bottom wall 26 and side walls 28-34 of the container 22 define an interior space 44 and upper edges 46 of the side walls 28-34 define an opening 48 into the interior space. The interior space 44 of the expanded container 22 may be filled through opening 48 with a product (not shown). The force of the product contained within the interior space 44 pressing outwardly against the side walls 28, 32 and bottom wall 26, and hinges 38*a-c* assist in maintaining the container 22 in the expanded position by inhibiting and/or preventing the panels 26*a,b*; 28*a,b*; and 32*a,b* from collapsing inwardly. In another embodiment, one or more latching mechanisms are used to maintain the container 22 in the expanded position. The lid 24 is adapted to cover the opening 48 to completely enclose the interior space 44.

The lid 24 has a product side 50 and a stacking side 52 opposite the product side. The lid 24 includes a cover plate 54, a peripheral flange 56 with an out-flared skirt 58, a tapered lead-in 60, and a retaining wall 62 with an in-turned lip 64 along an upper edge thereof. The flange 56 and lead-in 60 define a groove 66 extending around an outer periphery of the cover plate 54 on the product side 50 of the lid 24. The cover plate 54 is adapted to cover the opening 48 of the container 22 when in the expanded position with the upper edge 46 of the side walls 28-34 fitting into the peripheral groove 66 of the lid 24 so that the product side 50 is facing the product contained in the interior space 44. The tapered lead-in 60 and flared skirt 58 help guide the upper edge 46 of the side walls 28-34 into the groove 66 as the lid 24 is placed over the opening 48. The lead-in 60 extends below the flared skirt 58 with a gentle enough taper to readily catch the side walls 28-34 and urge them outwardly if they are bowed inwardly. For this purpose, the lead-in 60 is tapered inwardly (i.e., toward the center of the lid 24) from the groove 66 a distance greater than any anticipated inward bowing of the side walls 28-34. The lead-in 60 is formed by the opposite side of a recessed channel 68 in the cover plate 54 inwardly spaced from the outer periphery of the cover plate; however, any form of tapered lead-in structure could be used. In one embodiment, the recessed channel 68 extends continuously around the cover plate 54, and in another embodiment, the recessed channel extends intermittently around the cover plate. Structural and/or esthetic relief indentations 70 in the cover plate 54 provide added structural integrity and/or esthetic designs to the lid 24. The retaining walls 62 protrude upwardly from and extend intermittently around the cover plate 54 to form a recess 72 on the stacking side 52 of the lid. The recess 72 is adapted to receive the container 22 in either the collapsed position or the expanded position so that the container can be stacked on to the stacking side 52 of the lid 24. The container 22 lies substantially flat within the recess 72 when in the collapsed position as partially depicted in dashed lines at 74 in FIG. 3. The lip 64 resiliently presses against the edges of at least one of the side walls 28-34 of the collapsed container 22 that is fitted within the recess 72 to releasably restrain the container within the recess by means of a snap-fit. A thumb tab 76 extending outwardly from the flange 56 provides a convenient mechanism for prying the lid 24 away from the container 22, both when the container is stacked within the recess 72, and when the lid is covering the opening 48.

Figure 4:
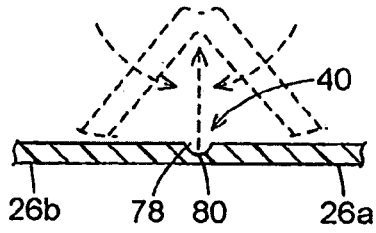
FIG. 4 is a fragmentary cross-sectional view taken generally along the lines 4-4 of FIG. 1.
Figure 5:
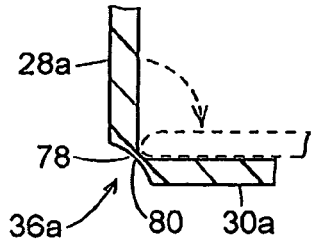
FIG. 5 is a fragmentary cross-sectional view taken generally along the lines 5-5 of FIG. 1.

Referring now to FIGS. 4 and 5, each living hinge 36*a-h* and 38*a-c* according to one embodiment of the present invention includes a notch 78 and a flexible hinge portion 80 as best seen in FIG. 4. The hinge portion 80 is slightly off center from the panel axis, which provides a measure of directionality to the hinge, and which conveniently lends itself to describing the hinges in the container 22 as being either interior hinges or exterior hinges. An interior hinge is a living hinge in which the hinge portion 80 is offset toward the interior space 44 of the expanded container 22. An exterior hinge is a living hinge in which the hinge portion 80 is offset away from the interior space 44 of the expanded container 22. Hinges 36*a-h* are interior hinges, and hinges 38*a-c* are exterior hinges. This placement of interior and exterior living hinges allows the hinge portion 80 of each of the hinges 36*a-h*, 38*a-c* to be rotated away from the notch 78 when converting the container 22 from the expanded position to the collapsed position as shown in FIGS. 4 and 5, which may also minimize interference between the panels on opposite sides of the hinge portion as those panels are rotated about the hinge portion.

Figure 6:
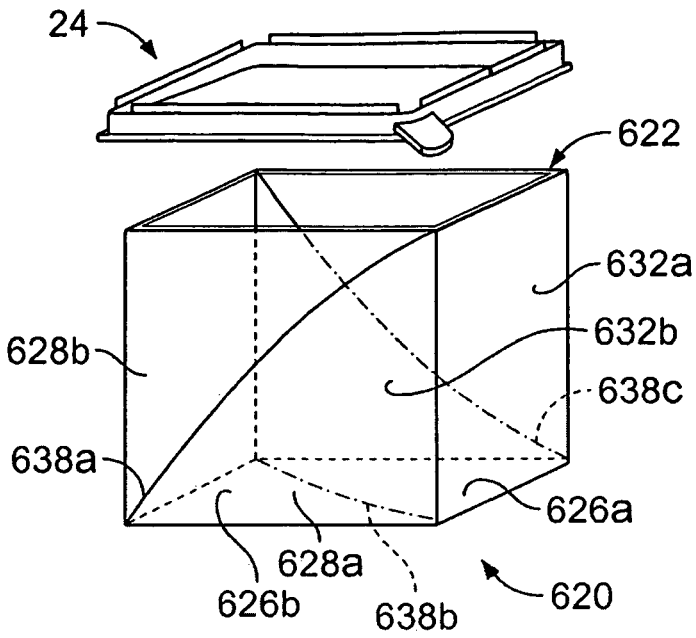
FIG. 6 is an isometric view of an embodiment of a collapsible container having arched living hinges.

Referring now to FIG. 6, another storage device 620 according to the present invention includes the lid 24 and a collapsible container 622, which is similar to container 22 except that hinges 638*a-c* are arched living hinges. An arched hinge is non-linear, such as being slightly curved between the two longitudinal ends of the hinge as shown for the hinges 638*a-c* in FIG. 6. (The curvature of the hinges 638*a-c* shown in FIG. 6 exaggerates the curvature of the hinges for illustrative purposes only). In one embodiment, the amount of curvature is sufficient to cause the hinges 638*a-c* to be bi-modal, having a stressed mode when the hinges are folded and an unstressed mode when the hinges are not folded. This bi-modal stress tendency continually urges the container 622 toward the expanded position because the stressed folded mode of the hinges 638*a-c* in the collapsed position urges side wall panels 626*a,b*; 628*a,b*; and 632*a,b* toward the unstressed unfolded mode of the expanded position. The collapsed container 622 can snap-fit into the recess 72 of the lid 24, which helps maintain the container in the collapsed position while being stored or stacked. For this purpose, the lid 824, discussed in detail herein below, may also be used with the container 622.

In one embodiment according to the present invention, the arched living hinges 638*a-c* are arched in the plane of the respective side or bottom, i.e., in-plane arched hinges. An in-plane arched hinge is formed by having an edge of the panel 628*a* arch inwardly and having an opposing edge of the opposing panel 628*b* arch outwardly complementary to the opposite panel edge, for example. In another embodiment, the arched living hinges 638*a-c* bulge outwardly, or are arched out of the plane of the respective side or bottom, i.e., out-of-plane arched hinges. An out-of-plane arched hinge is formed by arcuately arching each of the opposing edges of two adjacent panels, such as 628*a* and 628*b*, outwardly. In a further embodiment, an out-of-plane arched hinge is formed by arching each opposing hingedly joined panel edge outwardly with a plurality of straight line segments that collectively form a convexly arched panel edge.

Figure 6A:
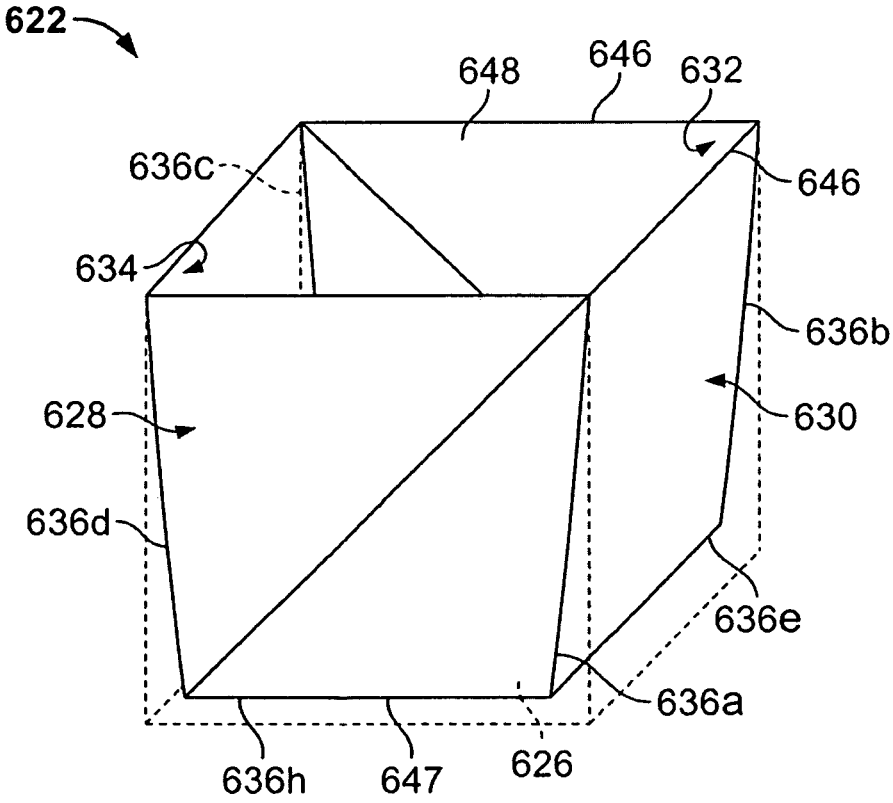
FIG. 6A is an isometric view of another embodiment of a collapsible container having arched living hinges.

In another embodiment according to the present invention having arched living hinges, shown in FIG. 6A, the collapsible container 622 is similar to the collapsible container 22, except that each of vertical corner hinges 636*a*, 636*b*, 636*c*, and 636*d* are out-of-plane arched hinges. A bottom wall 626 and an opening 648 are square, and sides 628, 630, 632, and 634 have straight upper edges 646 and straight bottom edges 647. In one embodiment, the opening 648 is larger than the bottom wall 626 so that the vertical hinges 636*a-d* are always inside a vertical projection of the opening 648 in order to facilitate easy ejection of the container 622 from a non-segmented mold during manufacture thereof. In another embodiment, the opening 648 is the same size as the bottom wall 626, and the curved vertical hinges 636*a-d* bow outwardly from the vertical projection of the opening. Other embodiments of arched hinge combinations include, for example, all of the hinges being out-of-plane arched hinges, at least one of the hinges being an out-of-plane arched hinge and the remaining hinges being straight hinges, and a combination of in-plane arched hinges, out-of-plane arched hinges, and straight hinges.

Figure 7:
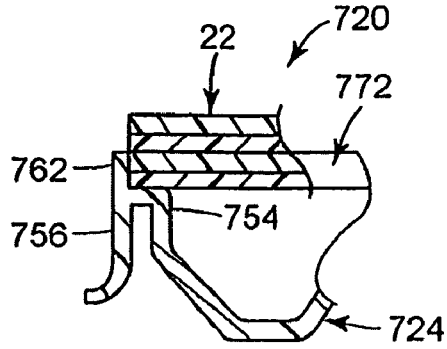
FIG. 7 is a fragmentary cross-sectional view similar to FIG. 3 of an embodiment of a storage device including a lid without a snap-fit retainer for retaining the collapsed collapsible container in the recess of the lid.

Referring now to FIG. 7, a storage device 720 similar to the storage device 20 includes the container 22 and a lid 724 similar to the lid 24. The lid 724 includes a cover plate 754, a peripheral flange 756, and a retaining wall 762 protruding above the peripheral flange 756 defining a recess 772 into which the collapsed container 22 may be fitted to lie flat against the cover plate 754. The retaining wall 762, however, is substantially smooth in that there is no in-turned lip along the upper edge of the wall, which allows the container 22 to slide freely into and out of the recess 772.

Figure 8:
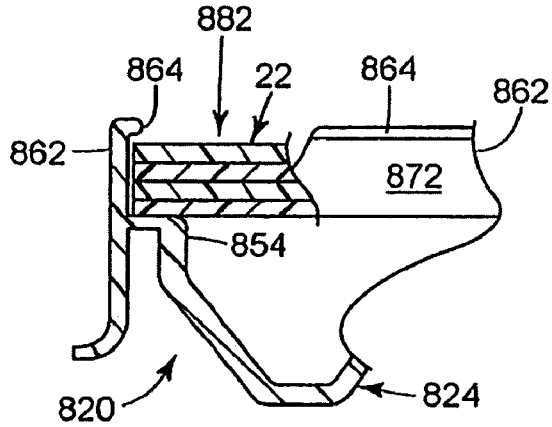
FIG. 8 is a fragmentary cross-sectional view similar to FIG. 7 of another embodiment of a storage device including a lid having a recess that completely accepts the collapsed collapsible container within a snap-fit retainer wall.

In FIG. 8, another storage device 820 similar to the storage device 20 includes the container 22 and a lid 824 similar to the lid 24. The lid 824 includes a cover plate 854 and a retaining wall 862 that extends intermittently around the cover plate to define a recess 872. In another embodiment, the retaining wall 862 extends completely around the cover plate 854. The retaining wall 862 protrudes upwardly from the cover plate 854 a height sufficient for the entire thickness of the collapsed container 22 to fit within the recess 872. An in-turned lip 864 along an upper edge of retaining wall 862 is spaced above the cover plate 854 a distance sufficient for the thickness of the entire collapsed container 22 to fit between the cover plate and the lip with a snap-fit. For this embodiment, it is convenient for a user of the storage device 820 that the intermittent retaining wall 862 defines an access notch 882 between adjacent sections of the wall, which allows the user access to the edge of the container 22 for prying the container past the lip 864 out of the recess 872.

Figure 9:
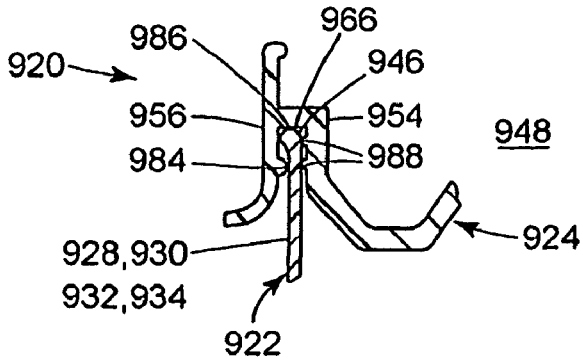
FIG. 9 is a fragmentary cross-sectional view similar to FIG. 7 of yet another embodiment of a storage device including a lid having a sealing mechanism and a snap-fit locking feature for retaining the lid on the side walls of the collapsible container.

Referring now to FIG. 9, yet another storage device 920 similar to the storage device 20 includes a collapsible container 922 similar to the container 22 and a lid 924 similar to the lid 24. The container 922 includes four side walls 928, 930, 932, 934 that define an opening 948 when the container 922 is in the expanded position. The lid 924 includes a cover plate 954 and a peripheral flange 956 around the cover plate that defines a peripheral groove 966 for receiving the side walls 928, 930, 932, 934 of the container 922 in the expanded position. A retention mechanism for releasably snap-fitting the lid 924 to the container 922 when in the expanded position to cover the opening 948 includes a rib 984 protruding from the flange 956 into the groove 966 and an out-turned lip 986 about an upper periphery of the upper edge 946 of the side walls 928, 930, 932, 934. The lip 986 is adapted to snap resiliently past the rib 984 to provide a snap-fit of the side walls 928, 930, 932, 934 into the groove 966. A sealing mechanism for creating a seal between the lid 924 and the side walls 928, 930, 932, 934 when the lid is covering the opening 948 includes a seal ring 988 extending continuously around and protruding into the groove 966. The seal ring 988 may be, for example, one or more small ridges, flexible flaps, embedded o-rings, or some other sealing protrusion. When the side walls 928, 930, 932, 934 are fitted into the groove 966, the seal ring 988 abuts against the side walls to provide a seal between the lid 924 and the side walls. In one embodiment, a seal ring 988 that comprises small ridges is used on a lid 924 made of a relatively soft or pliable material. In another embodiment, an upper wall of the groove 966 in the lid 924 is urged into sealing engagement with a top portion of the upper edge 946 by resilient interaction between one or more retention ridges or bumps on the lid and the container, such as, for example, between the out-turned lip 986 and the rib 984, or between similar structures.

Figure 10:
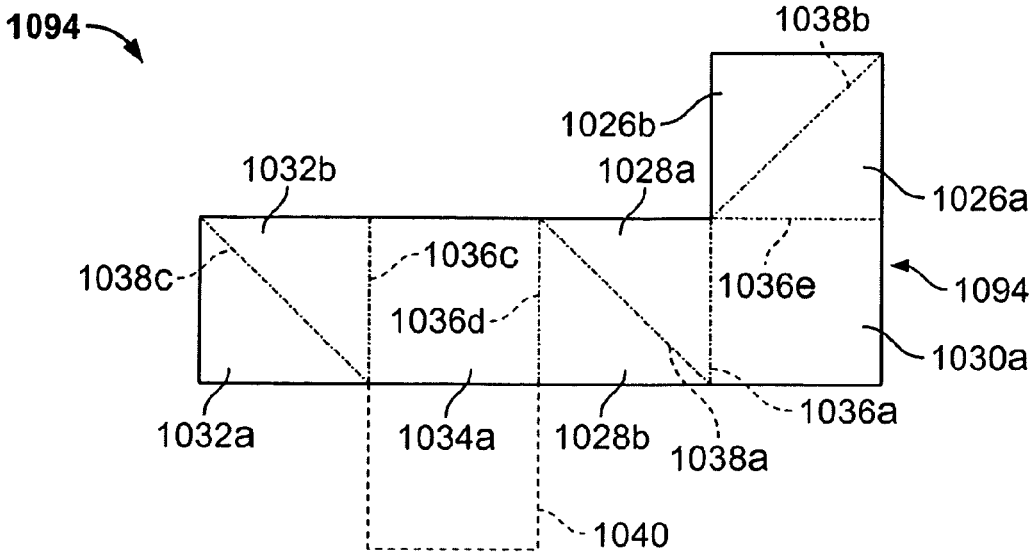
FIG. 10 is a plan view of a sheet of material to be formed into a collapsible container similar to the container of FIG. 1.

Referring now to FIG. 10, a blank for use in a method of forming a container similar to container 22 is shown, in which a sheet 1094 of resilient thermoformed plastic material is formed flat in a splayed form. Hinges 1038*c*, 1036*e*, 1036*a*, 1038*a*, 1036*d*, 1036*c*, and 1038*b* may be, for example, mechanically stamped and/or thermoformed into the sheet 1094 between adjacent panels 1026*a,b*; 1028*a,b*; 1030*a*; 1032*a,b*; 1034*a*. When the panels 1026*a,b*; 1028*a,b*; 1030*a*; 1032*a,b*; 1034*a* are folded to form the expanded box shape of the container, the remaining hinges are formed with a flexible membrane, such as an adhesive tape, a flexible plastic, a cloth, a caulking, an adhesive, an adhesive strip, etc. In another embodiment, the panels 1026*a,b*; 1028*a,b*; 1030*a*; 1032*a,b*; 1034*a* of the container 22 are formed of cardboard or thick paper and are hingedly connected with glue or tape (not shown). In yet another embodiment, the panels 1026*a,b*; 1028*a,b*; 1030*a*; 1032*a,b*; 1034*a* are formed of other resilient materials and the hinges 1038*c*, 1036*e*, 1036*a*, 1038*a*, 1036*d*, 1036*c*, and 1038*b* are formed of other flexible materials and joined to the panels. In a different embodiment, a panel 1040 (shown in phantom) is hingedly attached to the panel 1034*a* to form a hinged lid for covering the opening 48 of the container 22 when in the expanded position.

Figure 11:
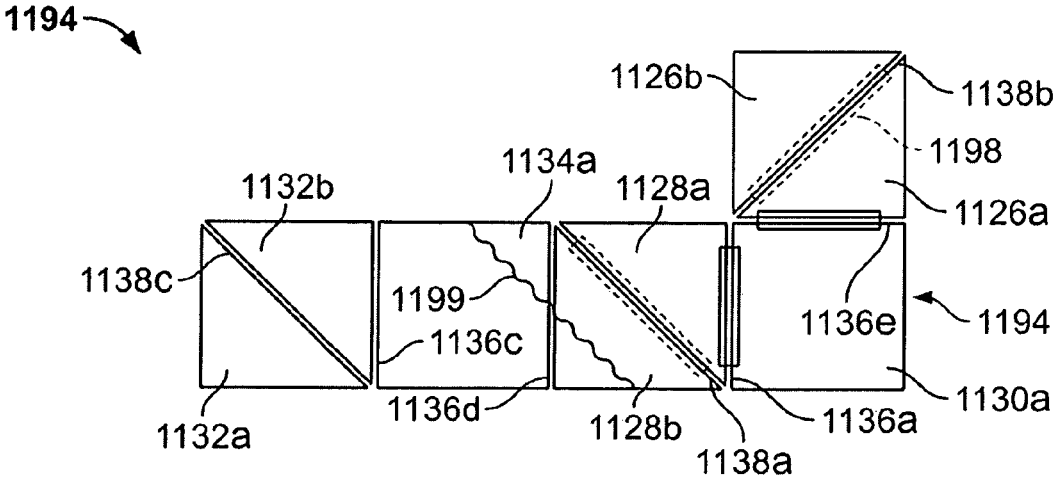
FIG. 11 is a plan view of an alternative arrangement of material to be formed into a collapsible container similar to the container of FIG. 1.
Figure 12:
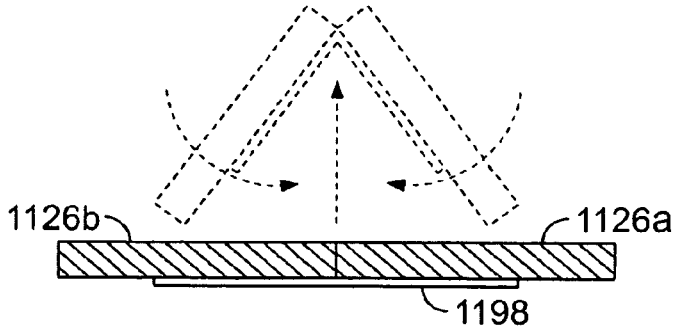
FIG. 12 is a fragmentary cross-sectional view similar to FIG. 4 of an alternative hinge.
Figure 13:
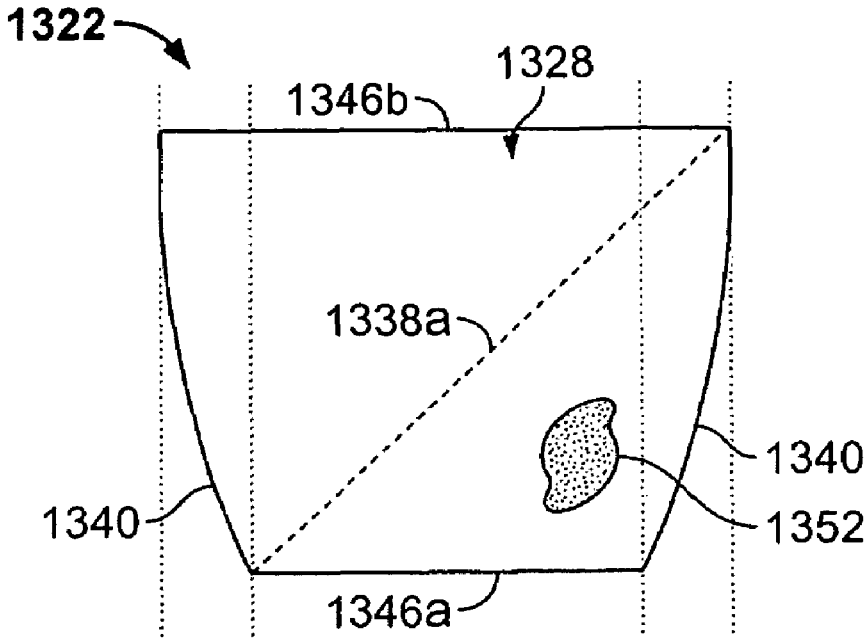
FIG. 13 is an elevational view of a bifurcated side of a collapsible container in the expanded position according to another embodiment of the present invention.
Figure 14:
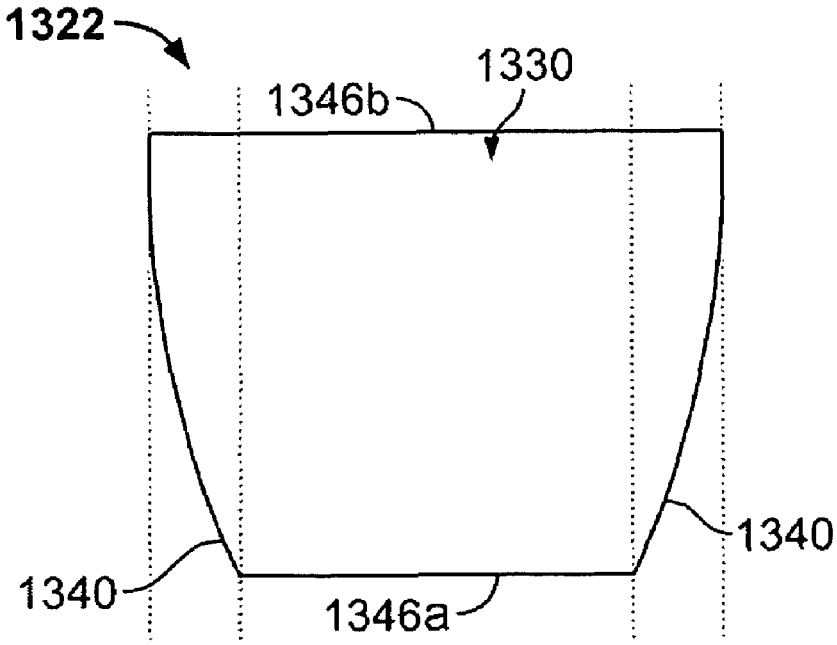
FIG. 14 is an elevational view of a non-bifurcated side of the collapsible container shown in FIG. 13.

In FIG. 11, another blank for use in an alternative method of forming a container similar to container 22 is shown, in which each panel 1126*a*, 1126*b*, 1128*a*, 1128*b*, 1130, 1132*a*, 1132*b*, 1134 is individually die cut from an extruded sheet of plastic. The panels 1126*a*, 1126*b*, 1128*a*, 1128*b*, 1130, 1132*a*, 1132*b*, 1134 are then arranged to form a splayed flat outline 1194 of the collapsible container, in which the edges of adjacent panels abut against each other. Adjacent pairs of the panels 1126*a*, 1126*b*, 1128*a*, 1128*b*, 1130, 1132*a*, 1132*b*, 1134 are then hingedly joined by welding and/or with an appropriate hinging material, such as a strip of flexible membrane 1198, an adhesive tape, caulking, adhesive, etc. The membrane 1198 is placed on one side of the panels for interior hinges 1136*a,c,d,e*, and the membrane is placed on the opposite side of the panels for exterior hinges 1138*a-c*, as shown diagrammatically in FIG. 12. Alternatively, a sheet 1199 of flexible backing material may be used to cover an entire side of the outline 1194 of the container. The sheet 1199 may be bonded to the panels 1126*a,b*, 1128*a,b*, 1130*a*, 1132*a,b*, 1134*a* with an adhesive and/or the sheet may be thermally bonded to the panels if the sheet is made of a material adaptive to thermal bonding, including, for example, a plastic film such as nylon, polyvinyl chloride, or a polyolefin such as polypropylene or polyethylene, in which case some of the joints between adjacent panels would be abutting joints, and some joints would be slightly spaced in order to minimize any interference between adjacent panels when folded.

Figure 15:
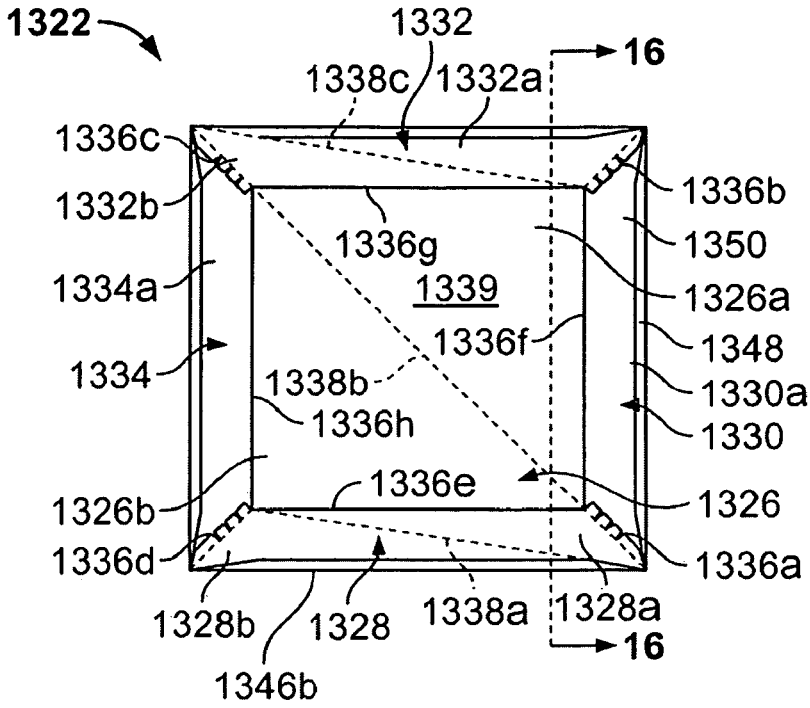
FIG. 15 is a plan view of the collapsible container shown in FIG. 13.

In FIGS. 13-16, another collapsible container 1322 (shown in an expanded position) includes four side walls 1328, 1330, 1332, 1334 extending generally vertically upwardly from four respective peripheral edges of a horizontal bottom wall 1326, which is substantially square. (All relational spatial descriptors, such as top, bottom, horizontal, vertical, etc., are in relation to the drawings for clarity of description and are not meant to be limiting to a particular global orientation of the container 1322.) The side walls 1328-1334 and bottom wall 1326 are formed of a resilient cellulosic material, such as paper, heavy gauge paper, or cardboard, which may be uncoated or coated with a liquid impermeable membrane, such as wax or polymer film, for example. Each side wall 1328-1334 has a straight bottom edge 1346*a* that is parallel with a straight top edge 1346*b* and opposing arched side edges 1340 that taper arcuately inwardly from the top edge to the bottom edge similar to the container 622 of FIG. 6A. The top edges 1346*b* define an opening into the collapsible container 1322 opposite the bottom wall 1326. The bottom edge 1346*a* of each side wall 1328-1334 is articulably connected to the respective edge of the bottom wall 1326 at a horizontal corner 1336*e*, 1336*f*, 1336*g*, 1336*h* by a fold line, which acts as an elongate hinge about which the adjacent panels pivot. The hinges may be formed or defined by folding, scoring, stamping, or utilizing any other known method. In addition, each side wall 1328-1334 is articulably connected to an adjacent side wall along a generally vertically oriented corner 1336*a*, 1336*b*, 1336*c*, 1336*d*, which also act as elongate hinges. Flexible hinges, such as diagonal fold lines 1338*a*, 1338*b*, 1338*c* in the side walls 1328-1332 and the bottom wall 1326, are arranged so that the collapsible container 1322 can be folded between the expanded position, which is generally cubic or box-shaped, and a substantially flat collapsed position (not shown) in a similar manner as described previously herein for the container 22. The fold lines 1338*a-c* are formed at preselected positions so as to prevent or discourage a user from accidentally folding the collapsible container 1322 along other lines or axes. For example, in the present embodiment, each of two opposing side walls 1328, 1332 and the bottom wall 1326 has a diagonal fold line 1338*a-c* extending between opposite diagonal corners of the respective side wall or bottom wall that defines two complementary wall panels 1326*a*, 1326*b*, 1328*a*, 1328*b*, 1332*a*, 1332*b*, respectively, which are generally triangular in shape in that each has three peripheral edges, although at least one peripheral edge may be non-linear. The remaining two opposing side walls 1330, 1334 are defined by a single wall panel 1330*a*, 1334*a*, respectively, which are generally rectangular in shape in that each has four peripheral edges, although at least one peripheral edge may be non-linear. The corners 1336*b*, 1336*g*, 1336*f*, and the diagonal fold line 1338*c* converge; the corners 1336*d*, 1336*h*, 1336*e*, and the diagonal fold line 1338*a* converge; the corners 1336*h*, 1336*g*, 1336*c* and the diagonal fold line converge; and the corners 1336*e*, 1336*f*, 1336*a*, and the diagonal fold line 1338*b* converge. In FIG. 15, the fold lines 1338*a-c* are seen as having the same diagonal orientation when viewed from an interior perspective of the collapsible container 1322 in the expanded position. The generally vertically oriented corners 1336*a-d* are defined at the junction of adjacent side edges of each adjacent pair of side walls 1328-1334. Each vertical corner 1336*a-d* is arched outwardly, which creates an arched elongate hinge along each vertically oriented corner. The curvature of the vertical corners 1336*a-d* causes the side walls 1328 and 1332 to bulge convexly outwardly at least partially along the diagonal fold lines 1338*a*, 1338*c*, which creates a popping feel as the diagonal fold lines move out of substantially linear alignment (i.e., over the center) when the collapsible container 1322 is urged into the expanded position. The outwardly bulged condition of the diagonal fold lines 1338*a*, 1338*c* creates an over-the-center latching action, which biases the collapsible container 1322 toward the expanded position. The collapsible container 1322 may be collapsed from the expanded position to the collapsed position by urging the diagonal fold lines 1338*a-c* back into linear alignment and toward an interior 1339 of the container, which causes the wall panels 1328-1334 to articulate at the diagonal fold lines 1338*a-c*, the vertically oriented corners 1336*a-d*, and the horizontal corners 1336*e-h* until the panels 1326*a*, 1326*b*, 1328*a*, 1328*b*, 1332*a*, 1332*b*, 1330*a*, 1334*a* are in substantially parallel, overlying relation with each other.

Figure 16:
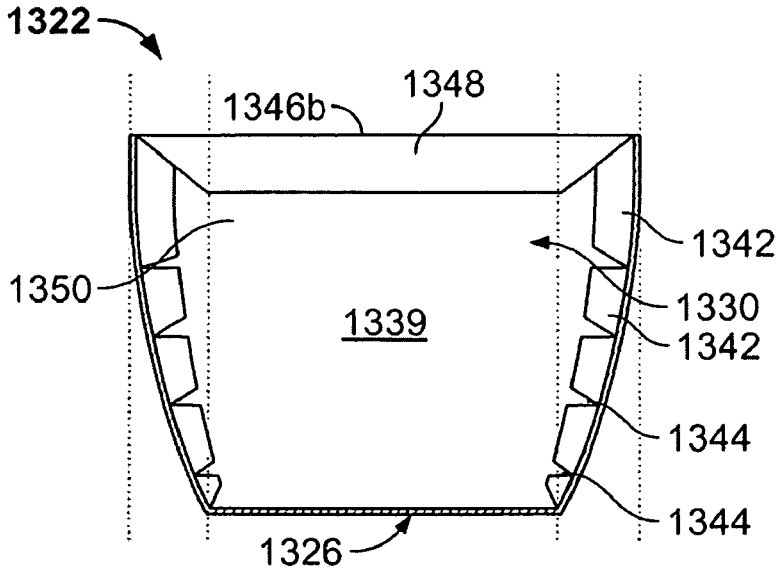
FIG. 16 is a cross-sectional view along the line 16-16 in FIG. 15.

As best seen in FIGS. 15 and 16, a series of tabs 1342 extending completely along and from each of the opposite side edges 1340 of the two-panel side walls 1328, 1332. The tabs 1342 are connected to the adjacent single-panel side walls 1330, 1334 with, for example, an adhesive. In another embodiment, the tabs 1342 extend from the single-panel side walls 1330, 1334 and are connected to the two-panel side walls 1328, 1332. A V-shaped notch 1344 separates each adjacent pair of tabs 1342 to provide clearance therebetween to accommodate the curvature along the vertical corners 1336*a-d*. A reinforcement, such as a folded down top lip or reinforcement flap 1348, connected to an inside surface 1350 of the top edge 1346*b* of each side wall 1328-1334 provides additional structural stiffness around the opening. At least each end of the top lips 1348 that is disposed adjacent to a diagonal fold line 1338*a*, 1338*c* is cut at an angle so as not to overlap the diagonal fold line. In the present embodiment, each end of the top lips 1348 is cut at an angle of about 45° or greater so as not to affect the collapsing motion of the container 1322 by either overlapping a diagonal fold line 1338*a*, 1338*c* or increasing the thickness of material directly adjacent to the vertically oriented corners 1338*a-d*. Any holes in the container 1322 between adjacent side walls 1328-1334 may be filled with adhesive or other filler material (not shown) to help make the collapsible container 1322 leak-proof or leak-resistant. Alternatively or additionally, the inside surface 1350 of the collapsible container 1322 may be coated with a liquid impermeable material (not shown), such as a plastic film and/or a wax coating. In another embodiment, the connections between adjacent side walls 1328-1334 and between the side walls and the bottom wall 1326 are continuous along each length thereof to help ensure that the collapsible container 1322 is substantially leak resistant at the connections.

One or more adhesive areas 1352 may be disposed on one or more positions on exterior surfaces of the bottom wall 1326 and the two-panel side walls 1328, 1332 so as to help retain the collapsible container 1322 in the collapsed position by adhering opposing panels 1326*a,b*, 1328*a,b*, and/or 1332*a,b* together only when the container is in the collapsed position. Further, the top edges 1346*b* of the side walls 1328-1334 may be rolled to provide added stiffness. A lid (not shown) that covers the opening when the container 1322 is expanded and holds the container when the container is collapsed may also be included. The lid may be designed to seal the container opening on an interior side, exterior side, and/or top side of the top edges 1346*b*. Protrusions may be disposed around the top edges 1346*b* to help retain a lid thereon. Any of the lids 24, 724, 824, 924 described herein may be adapted for use with the collapsible container 1322 by being correctly sized and/or being formed of suitable material.

Figure 17A:
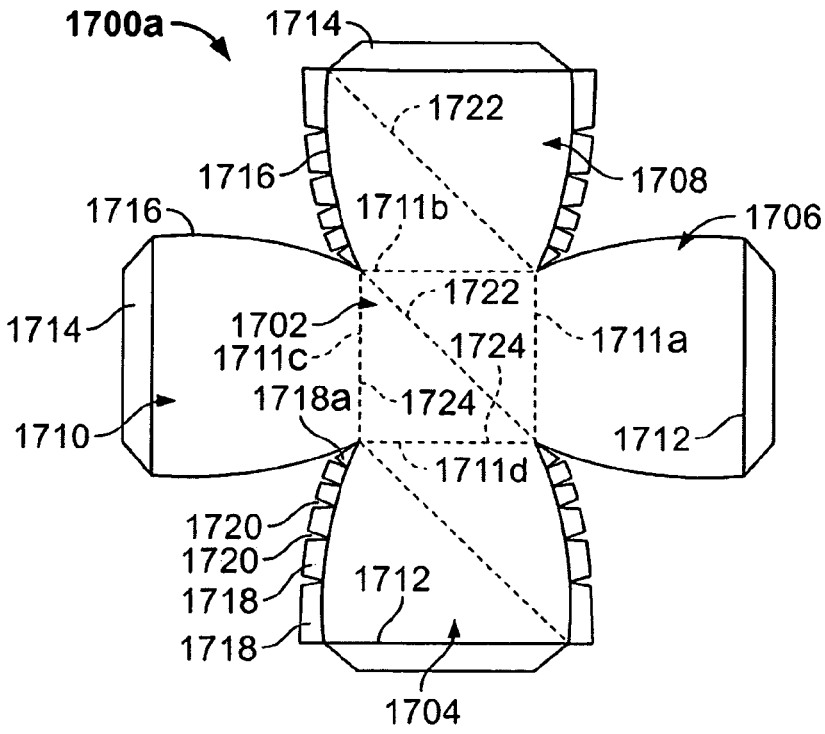
FIG. 17A is a plan view of a blank from which the collapsible container shown in FIGS. 13-16 may be formed.
Figure 17B:
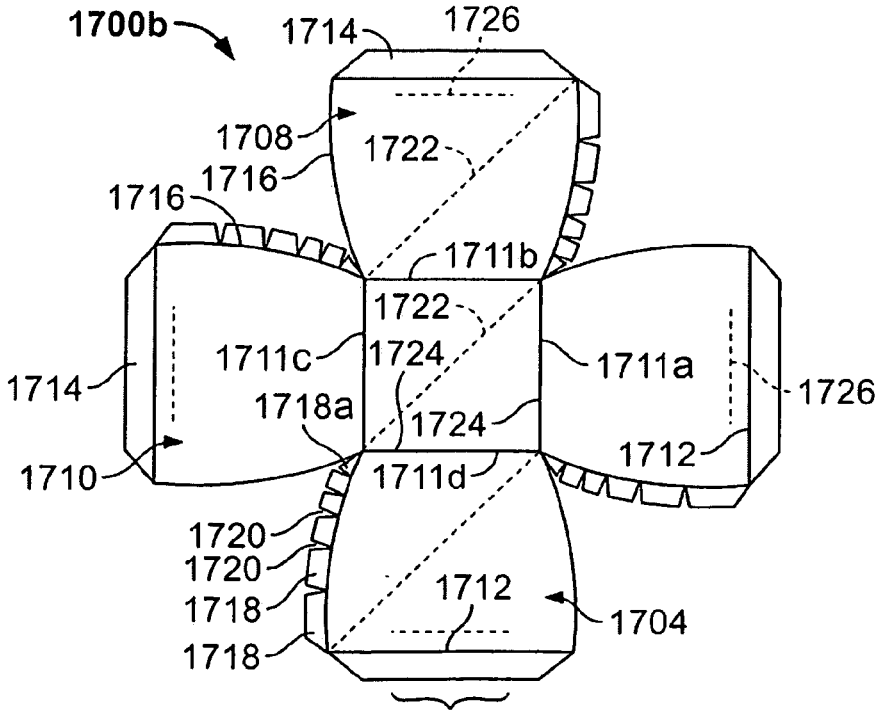
FIG. 17B is a plan view of another blank from which a collapsible container similar to that shown in FIGS. 13-16 may be formed.

The collapsible container 1322, for example, is formed by first cutting a flat sheet (not shown) of suitable material, such as cardboard or heavy gauge paper, into the form of a flat blank 1700, shown in FIG. 17A or a flat blank 1700*b* shown in 17B in which similar structures are given the same reference numerals. Of course, the blanks 1700*a* and 1700*b* may also be formed of other materials, such as cardboard, plastic, or metal, and combinations thereof, such as laminates, for example, that have adequate structural rigidity to maintain the collapsible container 1322 in the generally cubic expanded position and still allow adequate foldability about the diagonal hinges 1338*a-c* and vertically oriented corners 1336*a-d* and horizontal corners 1336*e-h*. Each blank 1700*a* and 1700*b* has generally a shape of a cross with a substantially square medial wall portion 1702 and four side wall portions 1704, 1706, 1708, 1710 foldably connected to the medial wall portion and extending radially outwardly from four respective peripheral edge portions 1711*a-d* of the medial wall portion. Each side wall portion 1704-1710 has a distal end 1712 that is substantially parallel to the respective edge portion 1711*a-d* of the medial wall portion 1702 and a flap portion 1714 disposed along the distal end. Each flap 1714 has inwardly tapered ends, such as being cut at about a 45° angle from the distal end of the side wall portion 1704-1710. For each side wall portion 1704-1710, the distal end 1712 is longer than the corresponding edge portion 1711*a-d* of the medial wall portion 1702, and side edges 1716 are arched by, for example, being convexly arcuate, or curved outwardly between the distal end and the medial wall portion. A plurality of tabs 1718 is located between each circumferentially adjacent pair of side wall portions 1704-1710. Each adjacent pair of tabs 1718 has a V-shaped notch 1720 therebetween, and each inner end tab 1718*a* has an inwardly tapered free end to provide clearance for folding along the curvature of the side wall portions 1704-1710. In the blank 1700*a*, each of two side wall portions 1704, 1708 extending from opposite edge portions 1711*b*, 1711*d* of the medial wall portions 1702 includes a set or a row of tabs 1718 extending along the arched side edges 1716 thereof. In the blank 1700*b*, a set or a row of the tabs 1718 is disposed along the circumferentially clock-wise side of each side wall portion 1704-1710. A diagonal fold line 1722 extending between opposite diagonal corners is disposed in each of the medial wall portion 1702 and two aligned side wall portions 1704, 1708. In the blank 1700*a*, the diagonal fold line 1722 is disposed in the two side wall portions 1704, 1708, but the diagonal fold line could alternatively be in the other two side wall portions 1706, 1710. The diagonal fold lines 1722 have the same diagonal orientation within each side wall portion 1704, 1708 and the medial wall portion 1702 and are substantially parallel with each other. In addition, FIG. 17A and FIG. 17B show embodiments where the diagonal fold lines 1722 are mirror images of each other. The collapsible container 1322 may be formed from other blanks (not shown) having different flattened layouts, but which include the same basic components arranged to be readily folded into the expanded form of the collapsible container.

To assemble the blanks 1700*a* or 1700*b* into a three-dimensional expanded position form of the collapsible container 1322, each side wall portion 1704-1710 is folded upwardly about a junction, or hinge line 1724, between the side wall portion and the respective edge portion 1711*a-d* of the medial wall portion 1702. The side edge 1716 of each side wall portion 1704-1710 is connected to the adjacent side edge 1716 of the adjacent side wall portion along an entire length thereof, thereby forming the outwardly arched side edges 1340 of the collapsible container 1322. In one embodiment, the fold lines 1722 and the hinge lines 1724 are pressed or cut into the blanks 1700*a*, 1700*b*. In addition, the diagonal fold lines 1722 disposed on the blanks 1700*a* and 1700*b* are arranged to allow the collapsible container 1322 to be folded from the three-dimensional expanded position to a the substantially flat collapsed position (not shown). In one embodiment, there are no gaps between adjacent side wall portions 1702-1710 or between the side wall portions and the medial wall portion 1702. The tabs 1718 are folded inwardly and secured, such as with adhesive, tape, or welding, to the adjacent side wall portion 1704, 1706, 1708, or 1710. Each flap 1714 is folded inwardly against the respective side wall portion 1704-1710 to form the top lip 1348 about the upper edges 1346 of the collapsible container 1322. A sealant (not shown), such as glue, caulking, wax, or a polymer laminate, for example, may be applied at the junction between each adjacent pair of the side wall portions 1704-1710 so that the collapsible container 1322 may be leak resistant. In the blank 1700*b*, each side wall portion 1704-1710 may further be crimped to form a ridge 1726 along the top edges 1346*b* of the collapsible container 1322 to provide added structural integrity. The ridge 1726 may also or alternatively be adapted to retain a lid (not shown), such as the lid 24, on the top edges 1346*b* when the collapsible container 1322 is in the expanded position.

Figure 18:
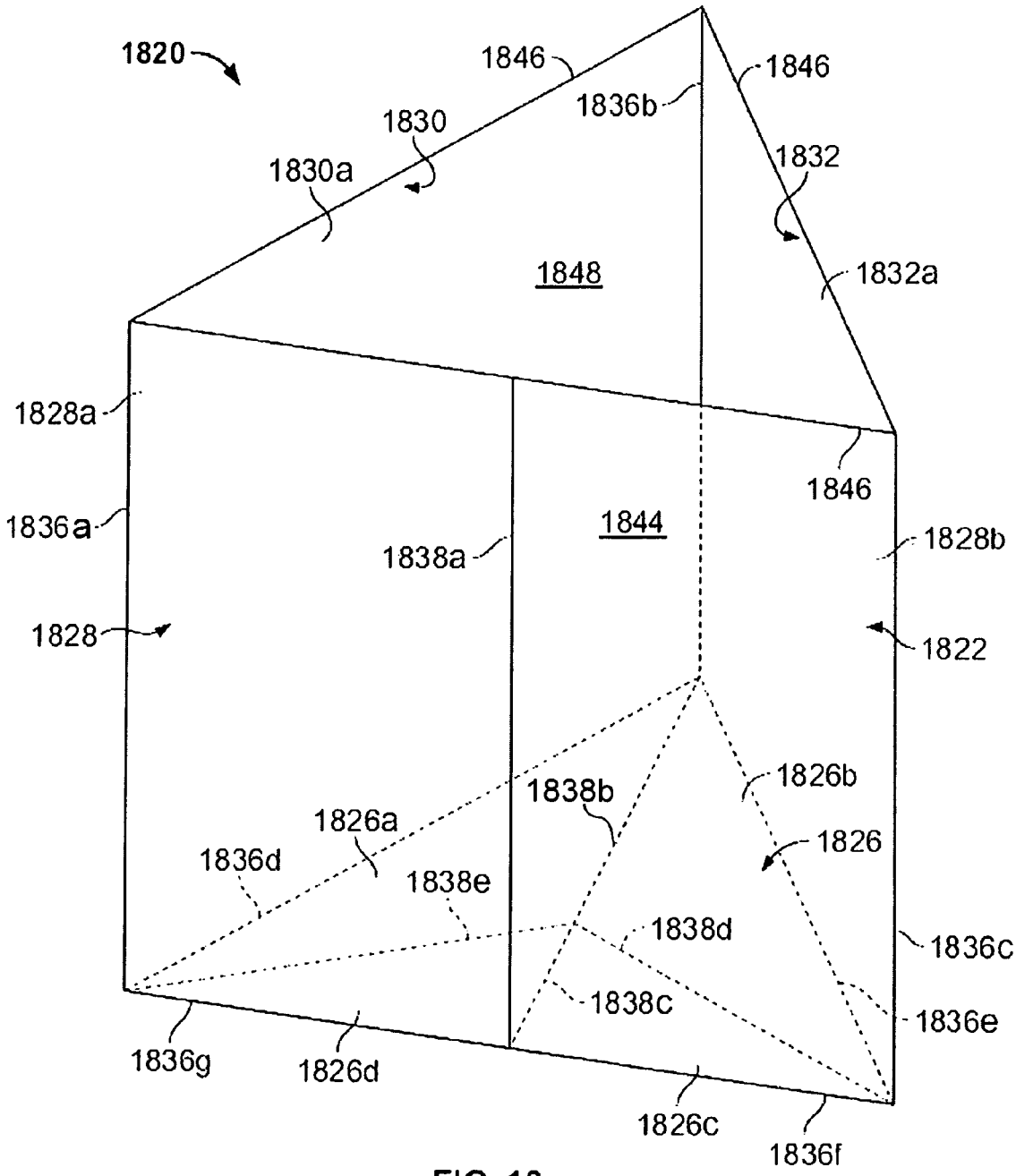
FIG. 18 is an isometric view of another embodiment of a collapsible container having three side walls in an expanded position.
Figure 19:
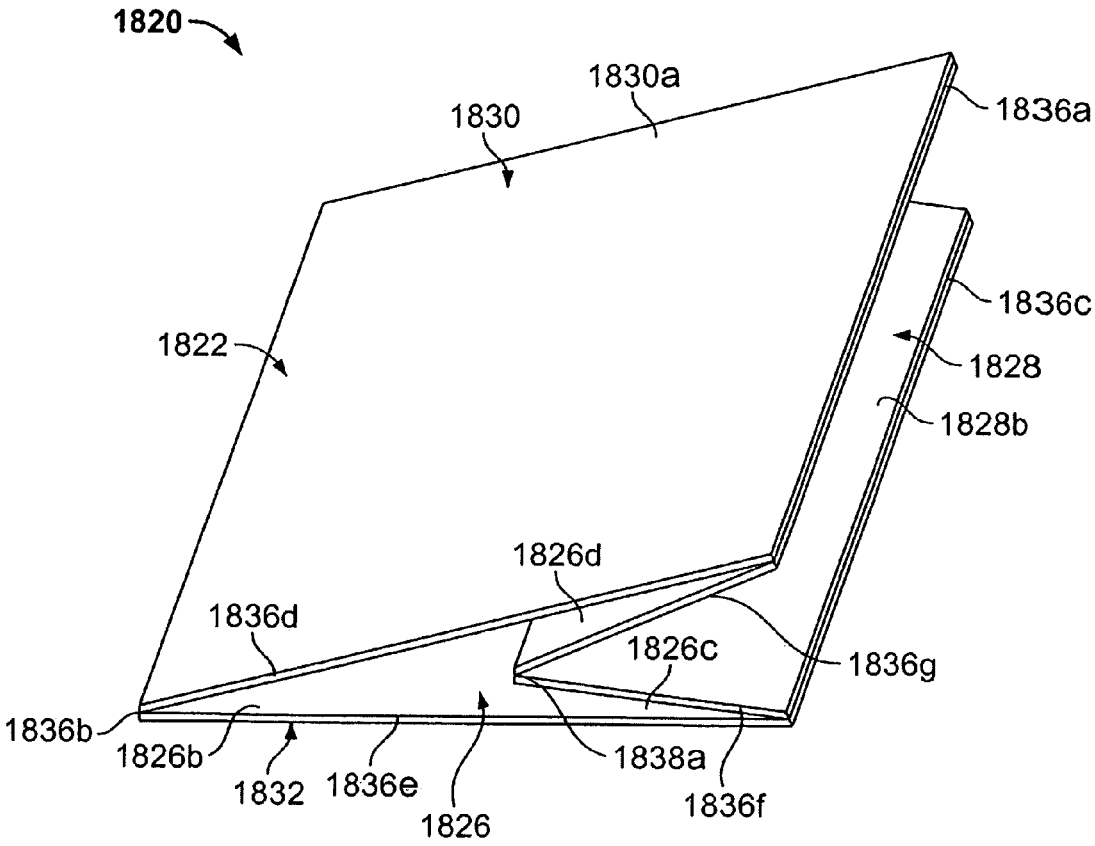
FIG. 19 is an isometric view of the collapsible container of FIG. 18 in a collapsed position.

Referring now to FIGS. 18 and 19, another storage device 1820 according to the present invention includes a collapsible container 1822. The container 1822 includes a bottom wall 1826 and three side walls 1828, 1830, 1832 extending upwardly from an outer periphery of the bottom wall 1826. The bottom wall 1826 is triangular in shape and in the present embodiment is fashioned to substantially form an equilateral triangle. However, in other embodiments the bottom wall 1826 may have a non-equilateral triangular shape. Each of the side walls 1828, 1830, 1832 is substantially rectangular in shape and similarly sized with respect to the other side walls, although in other embodiments one or more of the side walls 1828, 1830, 1832 may have a different shape and/or size.

The bottom wall 1826 comprises four complementary triangular panels 1826*a*, 1826*b*, 1826*c*, 1826*d* hingedly joined together to form the bottom wall 1826. Further, the side wall 1828 comprises a pair of complementary rectangular panels 1828*a*, 1828*b* similarly joined together to form the side wall 1828. Each of the side walls 1830, 1832 comprise a single panel 1830*a*, 1832*a*, respectively. Each panel 1826*a*, 1826*b*, 1826*c*, 1826*d*, 1828*a*, 1828*b*, 1830*a*, and 1832*a* is connected to adjacent panels by one of straight living hinges 1836*a*, 1836*b*, 1836*c*, 1836*d*, 1836*e*, 1836*f*, 1836*g*, 1838*a*, 1838*b*, 1838*c*, 1838*d*, 1838*e* such that the container 1822 may be converted from the expanded position shown in FIG. 18 to the substantially flat collapsed position shown in FIG. 19. The living hinges 1836*a-g* and 1838*a-e* are similar to those described above in connection with FIGS. 5 and 6. However, any hinge described herein may be used with the present embodiment, e.g., one or more of the hinges 1836*a-g* and 1838*a-e* may be arched hinges similar to the ones depicted in FIGS. 6 and 6A.

The conversion from the expanded position to the collapsed position is accomplished by pushing panels 1830*a* and 1832*a* inwardly toward each other about hinge 1836*b* so that the hinges 1836*a* and 1836*c* at opposite ends of the panels 1830*a*, 1832*a*, respectively, converge toward one another. Further movement of the panels 1830*a*, 1832*a* results in the panels 1828*a*, 1828*b* rotating inwardly toward one another about the hinge 1838*a* and the panels 1826*a-d* collapsing upwardly about hinges 1836*d-g*, respectively, and inwardly about hinges 1838*b-e*. Eventually, the panels 1826*a-d*, 1828*a*, 1828*b*, 1830*a*, and 1832*a* collapse into the configuration shown in FIG. 19. The collapsed container 1822 may be expanded by reversing the process. Another method of converting the container 1822 to the collapsed position is to push the hinge 1838*a* of the side wall 1828 and/or the hinges 1838*b-e* of the bottom wall 1826 inwardly and/or upwardly, respectively, (as depicted in FIG. 18), which causes the same folding and collapsing motion of the panels 1826*a-d*, 1828*a*, 1828*b*, 1830*a*, and 1832*a* as heretofore described.

In the expanded position, the bottom wall 1826 and side walls 1828-32 of the container 1822 define an interior space 1844. Upper edges 1846 of the side walls 1828-32 define an opening 1848 into the interior space. A lid (not shown) may be provided to cover the opening 1848 to completely or partially seal the interior space 1844. Any of the lids disclosed herein may be modified to fittingly engage with the presently described four sided storage device 1820 to maintain similar structural and functional characteristics while being adapted to fit onto the container 1822.

Other embodiments of the invention including all the possible different and various combinations of the individual features of each of the foregoing described embodiments are specifically included herein.

INDUSTRIAL APPLICABILITY

A storage device having a collapsible container and lid according to the present invention may be used to store any number and types of items or substances. The collapsible container and lid may have any convenient size ranging from very small to very large. A specific use contemplated for the storage device is for containment and storage of food products. The food products are stored within the interior of the collapsible container when in the expanded position, and the lid is used to close the collapsible container. When no food products are stored in the storage device, the collapsible container may be collapsed to the collapsed position and placed within a recess in the lid to provide for convenient storage of the entire storage device in a compact form. A collapsible container made of paper as described herein provides a convenient and inexpensive disposable collapsible container.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive right to all modifications within the scope of the impending claims is reserved.

We claim:

1. A container, comprising:

a plurality of wall panels hingedly connected so as to articulate between an expanded position and a collapsed position, the wall panels defining at least a bottom wall having four peripheral edges, a first side wall, a second side wall, a third side wall, and a fourth side wall;

wherein each of the first, second, third, and fourth side walls is hingedly connected to a different one of the peripheral edges of the bottom wall; and wherein the second side wall is connected to the first side wall at an arched elongate hinge, the second side wall is hingedly connected to the third side wall, the third side wall is hingedly connected to the fourth side wall, and the fourth side wall is hingedly connected to the first side wall;

wherein each of the first side wall, the third side wall, and the bottom wall comprises at least two wall panels defining a hinged connection extending substantially between diagonal corners thereof, wherein each of the second side wall and the fourth side wall comprises at most one wall panel, wherein the wall panels are adapted to articulate between the expanded position and the collapsed position about the arched elongate hinge and the hinged connections, and wherein the hinged connection extending substantially between the diagonal corners of the first side wall bulges outwardly to lock the container in the expanded position.

2. The container of claim 1, wherein each of the wall panels is articulably connected to each adjacent wall panel.

3. The container of claim 1, wherein the bottom wall is substantially square.

4. The container of claim 1, wherein at least one of the wall panels has a non-linear edge.

5. The container of claim 1, wherein the second side wall is hingedly connected to the third side wall at a second arched elongate hinge, the third side wall is hingedly connected to the fourth side wall at a third arched elongate hinge, and the fourth side wall is hingedly connected to the first side wall at a fourth arched elongate hinge.

6. The container of claim 1, wherein the arched elongate hinge comprises a plurality of tabs, the tabs connecting the first side wall and the second sidewall, and a notch disposed between adjacent tabs.

7. The container of claim 1, wherein the wall panels comprise a resilient cellulosic material.

8. The container of claim 7 further comprising a substantially liquid impermeable coating on an interior surface of the bottom wall and the four side walls.

9. The container of claim 1, wherein each hinged connection comprises a fold.

10. The container of claim 1, wherein each of the hinged connections and the arched elongate hinge is substantially continuous between the respective side walls and bottom wall.

11. The container of claim 1 further comprising an adhesive disposed on an exterior surface of at least one of the wall panels, wherein the adhesive is in a position so as to engage another one of the wall panels when the container is in the collapsed position, a reinforcement flap disposed along a top edge of at least one of the side walls, and a ridge disposed adjacent the top edge.

12. A collapsible container, comprising:

a bottom wall having four peripheral edges;

a side wall articulably connected to each peripheral edge of the bottom wall;

each side wall articulably connected to an adjacent side wall along a corner thereof; and a diagonal fold defined in each of two opposing side walls and the bottom wall;

wherein each of the corners is arched along a length thereof, and wherein the side walls and the bottom wall articulate at the respective folds, the peripheral edges, and the corners between a substantially flat collapsed state and an expanded state defining four side walls, a bottom wall, and an opening opposite the bottom wall, and wherein the sidewalls are locked into the expanded position as the diagonal fold moves out of substantially linear alignment with respect to the peripheral edges into the expanded position.

13. A collapsible container having a collapsed position and an expanded position, comprising:

a bottom wall having four peripheral edges;

a side wall articulably connected to each peripheral edge of the bottom wall;

each side wall articulably connected to each adjacent side wall along a vertical corner thereof; and a diagonal fold defined in each of two opposing side walls and the bottom wall and creating a fold line, wherein each of the vertical corners is curved and causes the two opposing sidewalls to bulge convexly outwardly at least partially along the diagonal fold line, whereby a popping feel occurs as the collapsible container moves into the expanded position.

14. The collapsible container of claim 13, wherein an over-the-center latching action is created by the outwardly bulged opposing sidewalls.

15. The collapsible container of claim 13, wherein the collapsible container can be collapsed from the expanded position into the collapsed position by urging the diagonal fold lines back into linear alignment and toward an interior of the container.

* * * * *